United States Patent [19]

Canup

[11] 3,961,613

[45] June 8, 1976

[54] CONTROLLED SPARK-DURATION IGNITION SYSTEM

[75] Inventor: Robert E. Canup, Richmond, Va.

[73] Assignee: Texaco Inc., New York, N.Y.

[22] Filed: Dec. 17, 1971

[21] Appl. No.: 209,060

[52] U.S. Cl. ..... 123/148 E; 123/148 CA; 315/209 CD

[51] Int. Cl.[2] ..... F02P 1/00

[58] Field of Search ..... 123/148 E, 148 IC; 315/209

[56] References Cited

UNITED STATES PATENTS

| | | | |
|---|---|---|---|
| 2,976,461 | 3/1961 | Dilger et al. | 123/148 E |
| 3,407,795 | 10/1968 | Aiken | 123/148 E |
| 3,531,738 | 9/1970 | Thakore | 123/148 E |

*Primary Examiner*—Charles J. Myhre
*Assistant Examiner*—Paul Devinsky
*Attorney, Agent, or Firm*—T. H. Whaley; C. G. Ries; Henry C. Dearborn

[57] ABSTRACT

A single-transformer high-frequency continuous-wave ignition system for an internal combustion engine. It employs a solid-state oscillator with a control winding for starting and stopping the oscillator, as timed by the engine. There is a D.C. bias current applied to the control winding. Cutting off the D.C. current ensures instantaneous starting of the oscillator, and an A.C. short circuit ensures stopping thereof.

11 Claims, 5 Drawing Figures

82
85
89
80
"HIGH VOLTAGE TO DISTRIBUTOR"
91
90
81
86
95
98
94
"TO BREAKER POINTS OR BREAKERLESS ENGINE CONTROLLED CIRCUIT"

105
107
"HIGH VOLTAGE TO DISTRIBUTOR"
101
100
108
106
109
102

111
112
110
"TO BREAKER POINTS OR BREAKERLESS ENGINE CONTROLLED CIRCUIT"

CONTROLLED SPARK-DURATION IGNITION SYSTEM

CROSS REFERENCES TO RELATED APPLICATION

This application relates to my earlier application Ser. No. 193,909, filed Oct. 29, 1971, now U.S Pat. No. 3,792,695.

BACKGROUND OF THE INVENTION

1. Field of the Invention

This invention concerns ignition systems in general, and more specifically deals with a continuous-wave, high-frequency type ignition system that is especially applicable to internal combustion engines.

2. Description of the Prior Art

High-frequency continuous-wave ignition energy has been proposed heretofore for use with internal combustion engines. Also, various arrangements using different kinds of oscillator to obtain such ignition energy have been proposed. However, there have been various difficulties and drawbacks encountered. One principal problem has been that related to a characteristic of inverters generally. It is the difficulty in starting oscillation instantaneously. This difficulty has rendered the use of inverters unacceptable for ignition systems because the initial timing of spark-voltage signals must be highly accurate. This is especially true for high-speed engines.

Furthermore, the concept of controlling a spark-duration interval with a single transformer circuit is new in this particular setting. It means that an optimum spark may be created for given conditions related to the characteristics of a particular internal combustion engine.

Consequently, it is an object of this invention to provide an improved controlled spark-duration ignition system that employs a high-frequency continuous-wave oscillator to generate the spark voltage.

Another object of this invention is to provide a controlled spark-duration ignition system that has provision for instantaneous starting of the spark oscillator which employs only a single transformer, as well as positive stopping thereof, for each spark interval.

SUMMARY OF THE INVENTION

Briefly, this invention concerns a controlled spark-duration ignition system for an internal combustion engine. It comprises, in combination, a high-frequency continuous-wave oscillator including a transformer having a high-voltage output winding, and first circuit means for connecting said output winding to a sparking circuit. It also comprises an oscillator control winding on said transformer for starting and stopping oscillation, and second circuit means for applying a D.C. bias current to said control winding when said oscillator is not oscillating. It also comprises means controlled by said engine crank angle for cutting off said D.C. bias current at the beginning of each spark-duration interval, and third circuit means connected to said control winding for stopping said oscillator at the end of each said spark-duration interval.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENTS

While ignition systems that employ high-frequency oscillators to produce spark voltages have been proposed in the past, there have been practical difficulties among which is the added cost of employing two transformers where the oscillator circuit is of the saturable-core type. On the other hand, a principal difficulty encountered with the single-transformer type circuit has been the problem of starting the oscillator instantaneously at the beginning of every sparking time interval.

The latter difficulty has been recognized in literature relating to inverters and describing solid-state oscillators of various types. However, although arrangements for starting the oscillator have been suggested, none of them is applicable to ignition systems. This difficulty is overcome by subject invention. It makes use of a control winding on the transformer of a solid-state oscillator that is used to generate the high-frequency A.C. signals which are applied via a high-voltage output winding to the spark plugs of an internal combustion engine.

Figure 1:
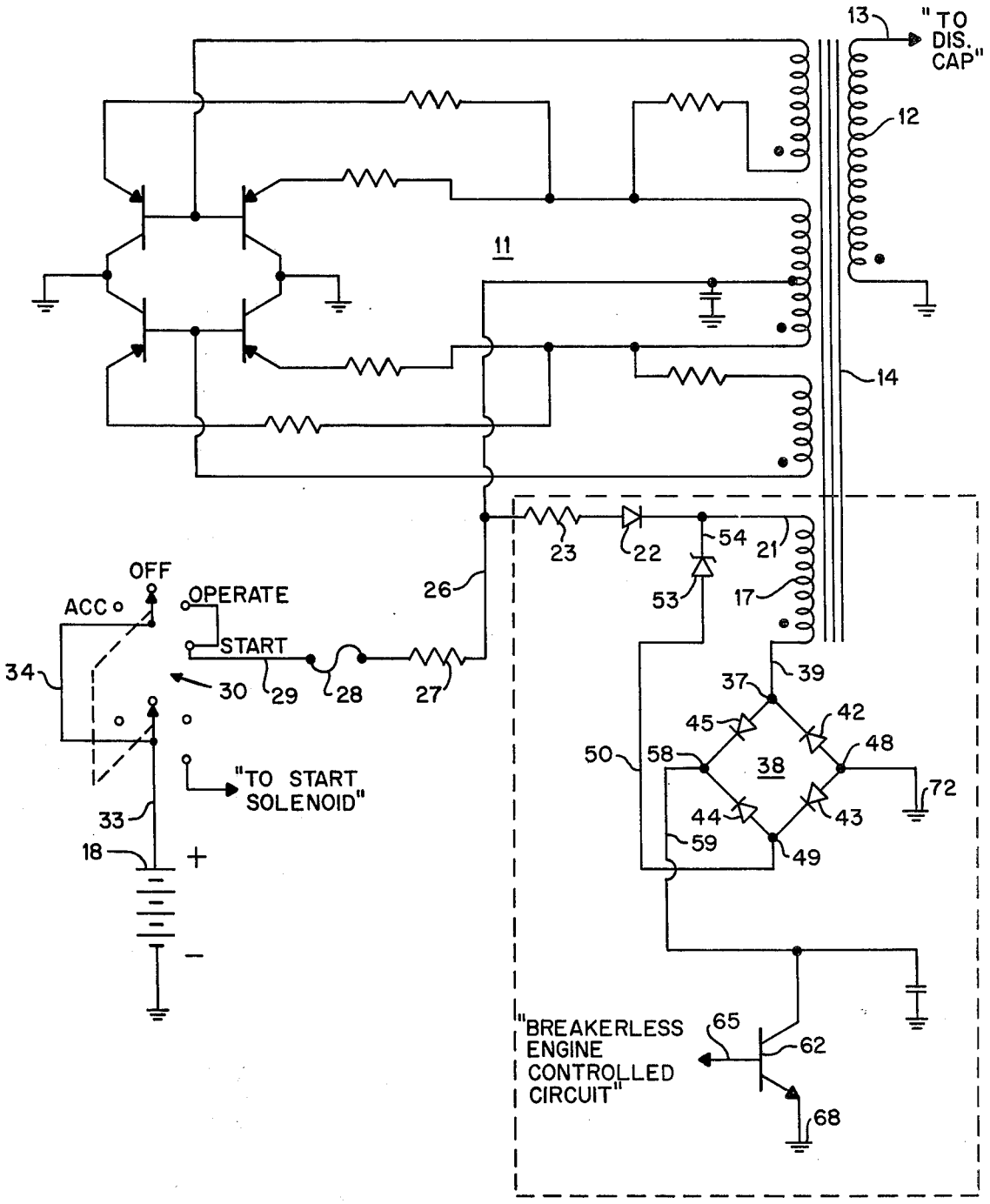
FIG. 1 is a circuit diagram showing a complete system according to the invention.

Referring to FIG. 1, there is illustrated an ignition system that employs an oscillator circuit 11 which is substantially the same as that shown and described in my earlier application mentioned above. This oscillator, when it is oscillating, generates a high-voltage continuous-wave spark signal in an output winding 12 which is located on a transformer 14. Winding 12 is connected to ground at one end, as shown. It has the other end connected to the distributor cap of an engine via a connector 13, as is indicated by the caption "TO DIS.CAP".

There is a control winding 17 on the transformer 14 which acts in starting and stopping the oscillator 11 in a manner to be described more fully below. The winding 17 has one end connected to a battery 18 via a circuit that includes a connector 21 which leads from the upper end (as illustrated in FIG. 1) of the winding 17. This connection may be traced from the connector 21 via a diode 22, a resistor 23, another connector 26, and another resistor 27 to a fuse 28. Fuse 28 is in series with another connector 29 which leads to the appropriate terminals of an ignition switch 30. When the ignition switch 30 is closed, i.e. switched to either start or operating position (as per the captions), the battery 18 is connected to the connector 29 via another connector 33 and a switch-blade bridging connection 34.

The other end of the control winding 17 is connected to a diagonal point 37 of a diode bridge 38, via a connector 39. The bridge 38 has four diodes 42, 43, 44 and 45, as shown. There is another diagonal point 48 that is connected to ground, as shown.

An opposite diagonal to point 37 is a point 49 of the bridge 38. It is connected by a connector 50 to a Zener diode 53, the other side of which is connected to the above-mentioned connector 21 via another connector 54.

A fourth diagonal point 58 of the bridge 38 is connected via a connector 59 to the collector electrode of a transistor 62. The emitter electrode of the transistor 62 is connected to ground, as shown, while the base electrode of the transistor is connected via a connector 65 to a control circuit (not shown). The control circuit determines the conduction, or nonconduction, of the transistor 62. As indicated by the caption adjacent to connector 65, the control signal for making transistor 62 conducting or nonconducting is derived from a so-called breakerless engine-controlled circuit. This might take various forms so long as it is controlled by the engine crank angle, in order to properly time the spark signals with engine operation.

The control winding 17 has a dual function. First, it acts to provide instantaneous starting of the oscillator 11 at the proper time related to engine operation. This function is accomplished by having a D.C. bias current flow in the winding when the oscillator is not oscillating, i.e., between spark-duration signals. Then, at the beginning of a spark interval, it is the decaying field created by the cutting-off of the D.C.-current flow that provides a positive and instantaneous starting action of the oscillator 11. Second, the other function of the winding 17 concerns stopping the oscillator, and it will be described more fully below.

Under steady-state conditions when the oscillator is not oscillating, the D.C. bias current flow through the winding 17 is controlled by the transistor 62. It is conducting at that time. The path of flow of such D.C. current may be traced from the positive terminal of battery 18 via the ignition switch 30, over conductor 29, fuse 28, resistor 27, conductor 26, resistor 23, diode 22 and conductor 21 to one side of the winding 17. Then the path continues from the other side of the winding 17 via conductor 39 and diode 45, through conductor 59 to the collector electrode of transistor 52. The path is completed through the conducting transistor from its collector electrode to the emitter electrode, and then on to a ground connection 68 from which the circuit is completed back to the negative terminal of the battery 18 via another ground connection 69, as shown.

When the engine-controlled circuit (not shown) provides an engine-timed signal over the conductor 65, it stops conduction of transistor 62. Consequently, the D.C. bias current flow is cut off, and this causes the above described flux decay in the core of the transformer so as to start the oscillator 11. When the oscillator 11 is oscillating, it produces a high-frequency continuous-wave output voltage in the winding 12 of the transformer, and this is connected to the proper spark plug of the engine via the distributor, as indicated by the caption adjacent to connector 13.

At the end of the sparking interval, when the engine-timed signal carried over connector 65 terminates, the oscillator 11 is shut down. This is accomplished by means of the control winding 17 which is designed to reduce the regenerative action of the oscillator sufficiently to stop the oscillation. This occurs when the winding 17 is effectively short-circuited so that it will carry a high induced current, and so overload the oscillator. While, to a certain extent, this action has been described in some of my earlier applications, it has been there employed in a circuit such that the A.C.-induced voltage in the winding 17 was short-circuited only on alternate half-cycles. That was because of the requirement for providing the D.C. bias current in the winding 17. In this invention, on the other hand, the stopping circuit provides for a short-circuit path that is effective on both half-cycles of the A.C. voltage which is induced in the winding 17. However, it still permits the necessary D.C. bias current flow in the manner described above. Such A.C. short-circuit path involves the diode bridge 38 and the Zener diode 53, as will now be described.

When the transistor 62 is made conducting (at the end of a sparking interval), it provides a path for the D.C. bias current flow (as described above) and, at the same time, completes an A.C. short-circuit path. The latter is effective on both half-cycles by reason of the fact that the Zener diode 53 becomes fully conducting as soon as the voltage applied to it exceeds the rating thereof. Thus, the induced voltage in winding 17 is of a sufficient amplitude to greatly exceed Zener diode breakdown, and when it avalanches, there is a short-circuit path for the A.C. current to flow.

The short-circuit path for the A.C.-current flow through winding 17 only exists when transistor 62 is conducting. It may be traced as follows: first, for the current flowing in a downward direction in the winding 17; it flows through conductor 39 via diode 45 to point 58 on the diode bridge 38; then via conductor 59 to the collector electrode of transistor 62; then via the emitter electrode of transistor 63 to the ground connection 68; then through ground connection 72 to point 48 on the diode bridge 38; from there via diode 43 to point 49 of the bridge 38; and on via connector 50 to one side of the Zener diode 53; finally, over the Zener diode 53 and via the connectors 54 and 21 to the other end of the winding 17.

Second, the reverse flow of the A.C. current may be traced as follows: upward from the top of the winding 17; via connectors 21 and 54; through the Zener diode 53 (which has avalanched); over the connector 50; to the point 49; it continues via the diode 44; to the point 58; over the connector 59; to the transistor 62 (collector-emitter path); via the ground connection 68; the other ground connection 72; to the point 48 of the diode bridge 38; via the diode 42; to the point 37; and back to the other end of the winding 17 over connector 39.

It will be appreciated that the above-described A.C. short-circuit path is isolated from the D.C. circuit for the battery 18 by means of the diode 22. This avoids undesired current flow through the battery circuit. Also, it is to be noted that the A.C. short-circuit arrangement permits a positive-action stopping of the oscillator at the end of each sparking interval. Otherwise, there sometimes has been a continuation of half-cycling oscillations in spite of a short-circuit path for one direction of A.C.-current flow. Of course, other arrangements might be employed for obtaining the desired full-wave short-circuit path so long as it makes provision for permitting the D.C. bias current to flow after the oscillator has been stopped.

With reference to FIGS. 2 to 5, there are shown a number of different modifications as to the particular inverter or oscillator circuit that is employed. Thus, the invention is applicable to inverters generally and, as mentioned above, it is particularly beneficial where the type of inverter used employs only a single transformer.

Figure 2:
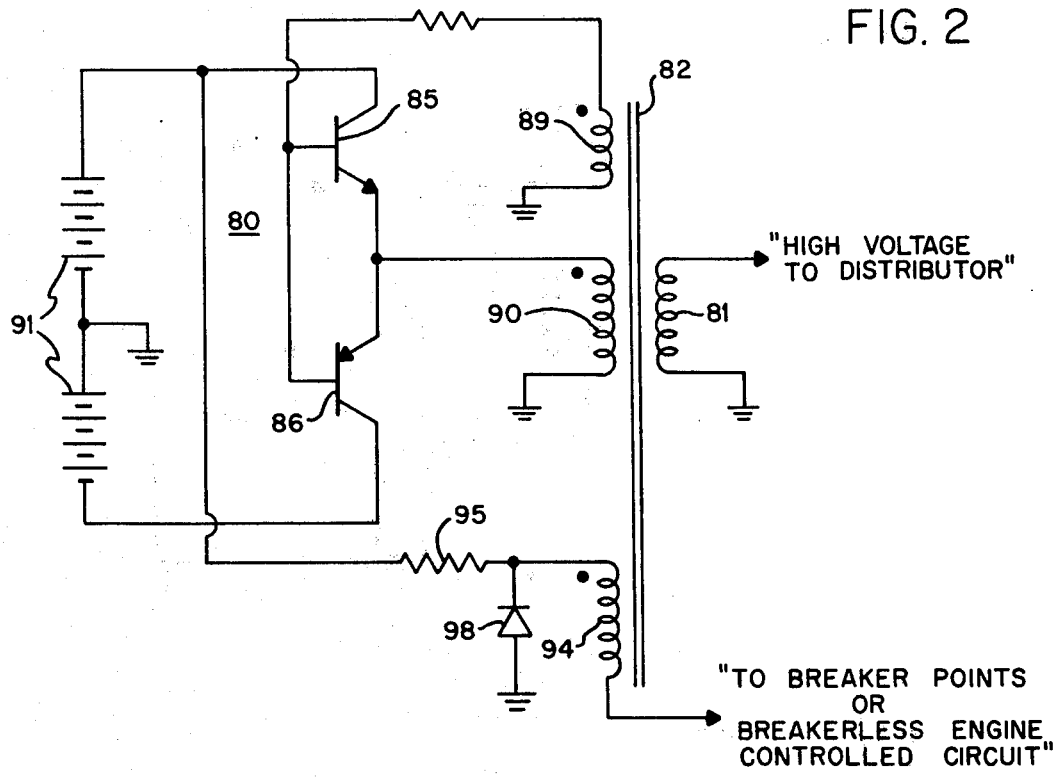
FIG. 2, FIG. 3, FIG. 4 and FIG. 5 are circuit diagrams illustrating different types of oscillator as used with a system according to the invention.

In FIG. 2, it will be observed that there is an oscillator 80 that feeds an output winding 81 of a transformer 82. The output signal is fed to the spark plugs of an engine, as is indicated by the caption HIGH VOLTAGE TO DISTRIBUTOR opposite the output lead from winding 81.

The oscillator 80 employs a complementary pair of transistors 85 and 86 of which transistor 85 is an N-P-N type while transistor 86 is a P-N-P type. These are connected in a known manner with a pair of windings 89 and 90, respectively, so that the desired oscillation will take place as driven by the D.C. voltage from a battery, or other D.C. source, 91. The battery 91 has a center tap grounded to complete the circuits with the windings 89 and 90.

The oscillator 80, per se, is known and has been described in a publication by RCA entitled "Power Transistors", Technical Series PM-81, at page 76.

The oscillator 80, as employed with this invention, has an additional winding 94 that is a control winding. It acts in a similar manner as does the winding 17 that was described above in connection with FIG. 1. This winding 94 is connected to one end of the battery 91 through a resistor 95. The other end of the winding is connected to ignition breaker points, or a breakerless switching element. In either case it controls the flow of D.C. bias current, as explained above. In addition, there is shown a diode 98 that acts as the A.C. short-circuit path for stopping the oscillator at the end of each spark-duration interval. Of course, the system may employ a full-wave A.C. short-circuit path arrangement which would be in accordance with the above-described system illustrated in FIG. 1. But, for the purpose of simplification, the FIG. 2 modification (as well as FIGS. 3–5) will be described without the more complicated oscillation-stopping arrangement even though it will be understood that the latter may be preferred.

Figure 3:
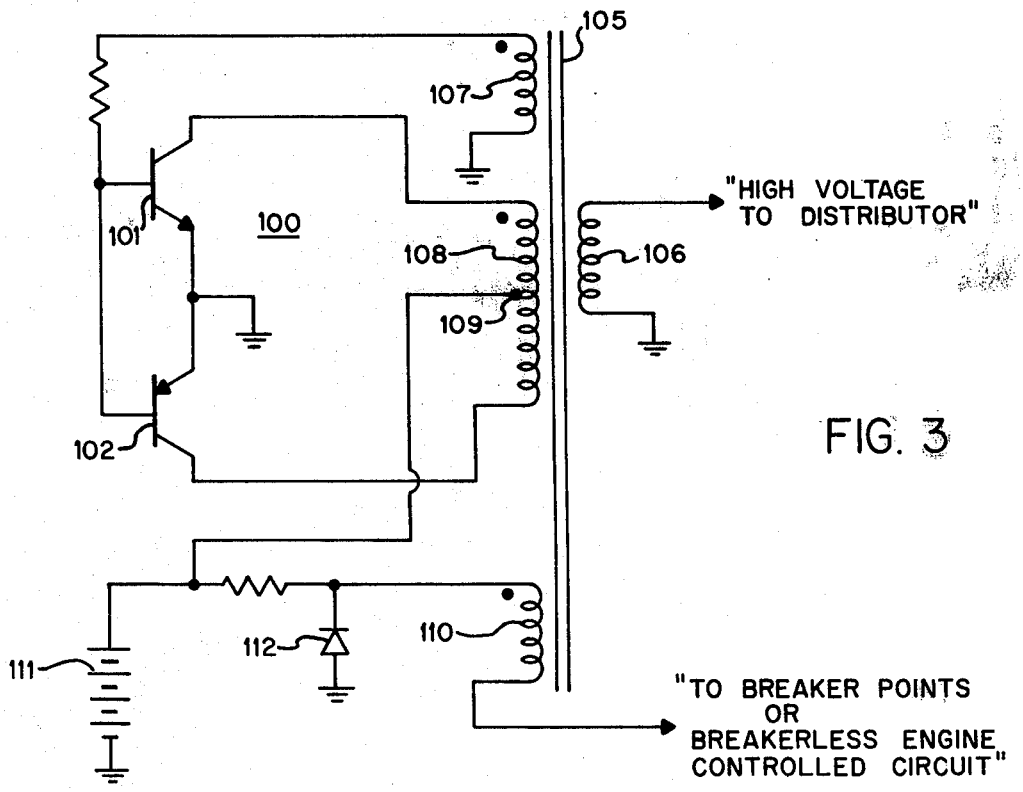

FIG. 3 illustrates another oscillator circuit 100 that is a variation of the oscillator 80 shown in FIG. 2. Oscillator 100 employs a complementary pair of transistors 101 and 102 which are N-P-N and P-N-P type transistors, respectively. This circuit also employs a single transformer 105. It has an output winding 106 as well as two oscillator windings 107 and 108, the latter being center-tapped. There is a battery 111 that has the positive terminal thereof connected to a center tap 109 on the winding 108. The negative terminal is grounded.

Here again, the FIG. 3 oscillator is a variation of the known type of converter shown in FIG. 2, so that the details of the operation are unnecessary. It will be observed also that, in accordance with this invention, there is a control winding 110. As explained before, it carries a D.C. bias current during the off-times of the sparking-signal oscillations, and such D.C. current is supplied from the battery 111 that also provides the driving voltage for oscillator 100. As before, there is also a diode 112 that provides the A.C short-circuit path to stop the oscillator.

As has been indicated, the oscillators, per se, are known circuits and individual ones have advantages and disadvantages. Thus, the oscillators employed in the modifications of FIGS. 2–5 are illustrated or suggested in technical publications concerning transistors, e.g. the RCA publication mentioned above, pages 72–76. Also, there is a Westinghouse publication entitled "Silicon Power Transistor Handbook", First Edition B-9394, pages 5–1 through 5–9.

Figure 4:
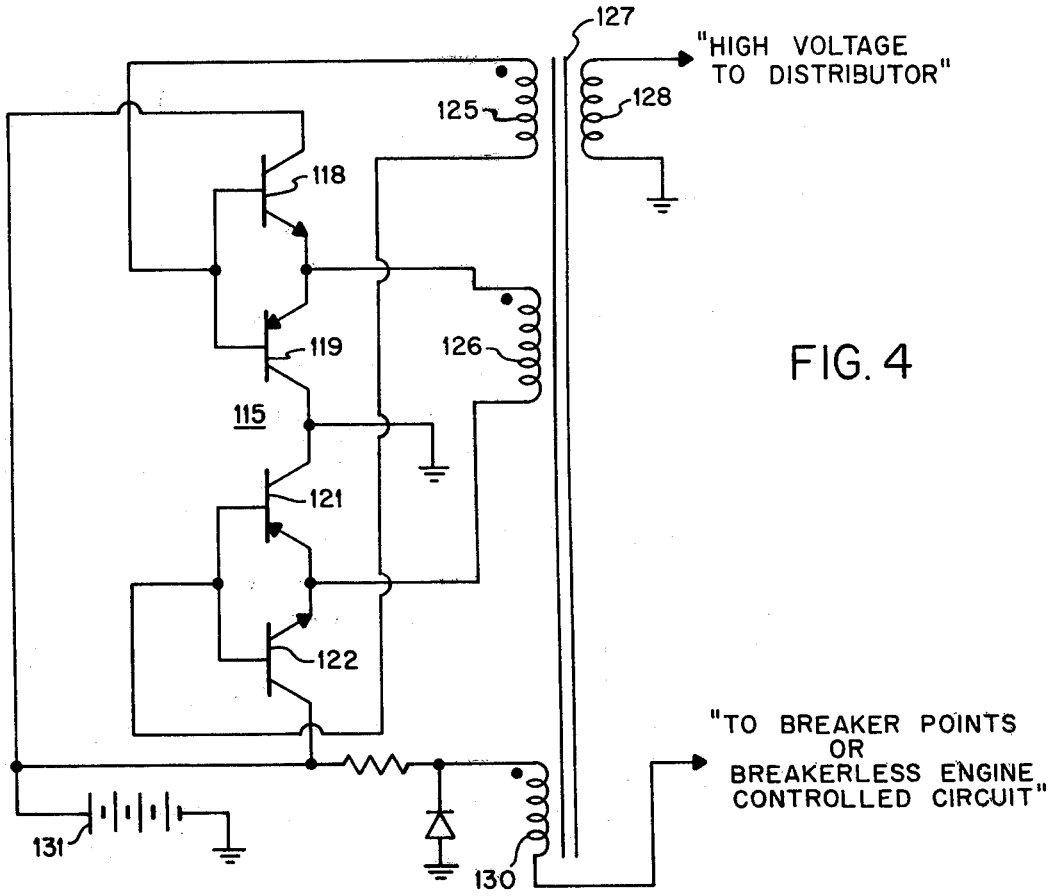

FIG. 4 illustrates another inverter, or oscillator 115. This is a so-called bridge type of inverter, and it makes use of two complementary pairs of transistors 118, 119 and 121, 122. These are connected together to form a bridge configuration in conjunction with a pair of windings 125 and 126 on a transformer 127. In this case, there is an output winding 128 to feed the sparking signal to the engine, as indicated. Also, as before, there is, in accordance with this invention, a control winding 130 on the transformer 127. This control winding 130 acts in the same manner as the respective windings 94 and 110 of FIGS. 2 and 3. There is, of course, also a battery 131 to supply the D.C. voltage for driving the oscillator and supplying the D.C. bias current, as before.

Figure 5:
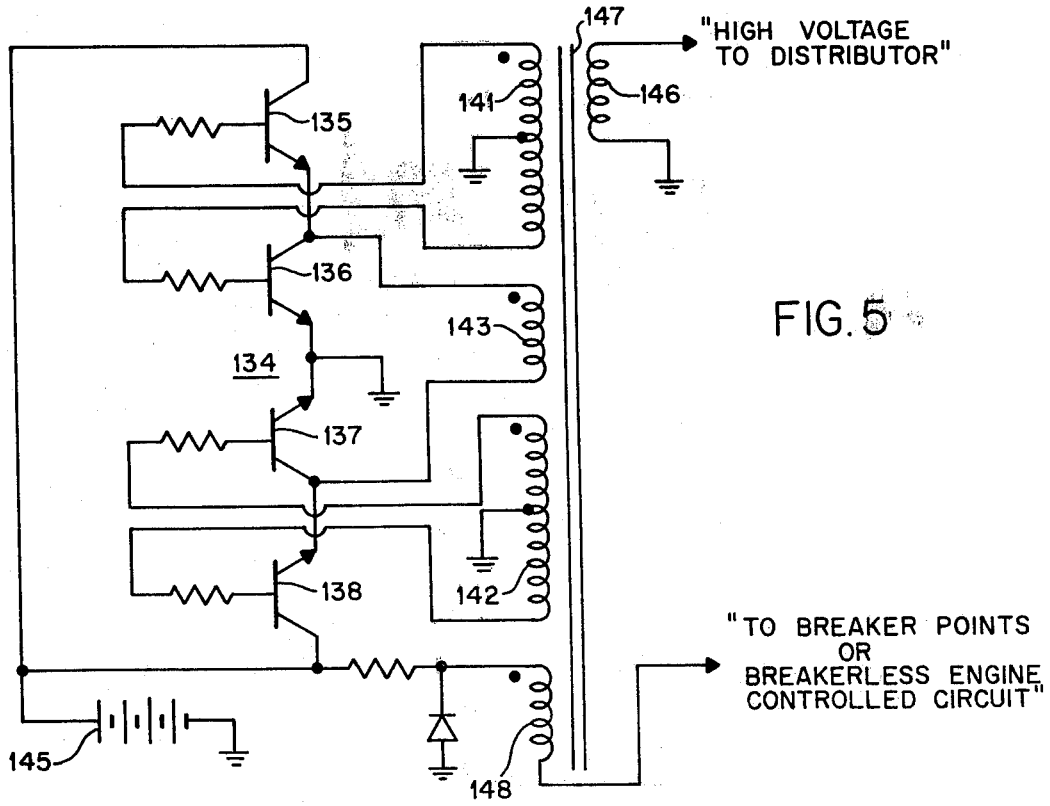

FIG. 5 illustrates one additional oscillator that may be employed with this invention. However, it makes use of additional transformer windings. Thus, there is an oscillator 134 that employs four transistors 135 through 138 which, in this instance, are all N-P-N-type transistors. The arrangement includes two center-tapped windings 141 and 142, plus another winding 143. These windings are interconnected, as shown, to make up the oscillator 134, which is driven by a battery 145. This ignition system is completed in the same manner as the other modifications, by having an output winding 146 on a transformer 147 in addition to a control winding 148 with its interconnection to the spark-timer, as described above, for determining the time and duration of the spark signals.

It may be noted once more that this invention provides for a controlled spark-duration ignition system, and this makes possible an ignition spark signal that may be designed for maximum efficiency with respect to internal combustion engines. While various attempts have been made to employ continuous-wave, high-frequency energy, these have lacked an important feature of this invention which concerns the ability to provide instantaneous starting of the oscillator, with positive stopping at the end of each spark-duration interval.

While particular embodiments of the invention have been described in considerable detail above in accordance with the applicable statutes, this is not to be taken as in any way limiting the invention but merely as being descriptive thereof.

What I claim is:

1. A controlled spark-duration ignition system for an internal combustion engine having a crank shaft, said system comprising in combination a high-frequency continuous-wave oscillator including first circuit means for connecting a source of D.C. power thereto and a transformer having a high-voltage output winding, second circuit means for connecting said transformer output winding to a sparking circuit, an oscillator control winding located on said transformer for starting and stopping oscillation of said oscillator, third circuit means for applying a D.C. bias current to said oscillator control winding when said oscillator is not oscillating, and means controlled by said engine crank angle for cutting off said D.C. bias at the beginning of each spark-duration interval.

2. A controlled spark-duration ignition system according to claim 1, further including fourth circuit means connected to said oscillator control winding for stopping said oscillator at the end of each said spark-duration interval.

3. A controlled spark-duration ignition system according to claim 2, wherein said fourth circuit means comprises a short circuit path from one end of said oscillator control winding to the other.

4. A controlled spark-duration ignition system according to claim 3, wherein said short-circuit path comprises an A.C. low-impedance path in shunt with said D.C. bias current source.

5. A controlled spark-duration ignition system according to claim 4, wherein said engine crank angle means comprises a switch connected in series with both said third circuit means and said fourth circuit means.

6. A controlled spark-duration ignition system according to claim 5, wherein said switch is electronic.

7. A controlled spark-duration ignition system according to claim 6, wherein said A.C. low-impedance path comprises a diode bridge and impedance means for blocking D.C. from said shunt path after said oscillator has stopped oscillating.

8. A controlled spark-duration ignition system according to claim 7, wherein said impedance means comprises a Zener diode.

9. A controlled spark-duration ignition system according to claim 1, wherein said oscillator comprises a solid-state inverter.

10. A controlled spark-duration ignition system according to claim 9, wherein said inverter comprises a pair of transistors.

11. A controlled spark-duration ignition system according to claim 10, wherein said pair of transistors are complementary connected N-P-N/P-N-P transistors.

* * * * *